US006615548B1

(12) United States Patent
Nakamura et al.

(10) Patent No.: US 6,615,548 B1
(45) Date of Patent: Sep. 9, 2003

(54) VARIABLE SIGHT-LINE GRANDSTAND SEATING ARRANGEMENT

(75) Inventors: Hiro Nakamura, Mauldin, SC (US); Hideaki Satake, Mauldin, SC (US)

(73) Assignee: Interkel, LLC, Kalamazoo, MI (US)

( * ) Notice: Subject to any disclaimer, the term of this patent is extended or adjusted under 35 U.S.C. 154(b) by 0 days.

(21) Appl. No.: 09/649,307

(22) Filed: Aug. 28, 2000

(51) Int. Cl.[7] ..... E04H 3/10; E04H 3/12; A47C 15/00

(52) U.S. Cl. ..... 52/6; 52/8; 52/9; 297/236

(58) Field of Search ..... 52/6, 8, 9, 183, 52/10, 7, 64; 297/236, 239

(56) References Cited

U.S. PATENT DOCUMENTS

| | | | | | |
|---|---|---|---|---|---|
| 5,517,789 | A | * | 5/1996 | Sugiyama | 52/10 |
| 5,913,776 | A | * | 6/1999 | Compagnone | 52/10 |
| 6,003,270 | A | * | 12/1999 | MacIntyre | 52/10 |
| 6,243,991 | B1 | * | 6/2001 | Iritani | 52/8 |

FOREIGN PATENT DOCUMENTS

| | | |
|---|---|---|
| FR | 2605037 | 4/1988 |

* cited by examiner

*Primary Examiner*—Carl D. Friedman
*Assistant Examiner*—Kevin McDermott
(74) *Attorney, Agent, or Firm*—Robert Kelley Roth

(57) ABSTRACT

A grandstand seating arrangement having seating level members arranged in sequentially elevated relation to one another. A rigid frame that couples and surrounds the seating members has a lower frame coupled to the lifting arrangements and an upper frame coupled rigidly to the lower frame. A lower stop is disposed on each stanchion support and arranged at a height corresponding to the height of the associated seating level member. Seating level member supports support the seating level members, each of which is coupled to, and displaceable along, a respective stanchion support. The seating level member supports are supported by lower stops when the lifting arrangements are in the lower most position. When the lifting arrangements raise the rigid frame, the seating level member supports and the seating levels thereon are sequentially raised from the respective lower stops.

16 Claims, 11 Drawing Sheets

VARIABLE SIGHT-LINE GRANDSTAND SEATING ARRANGEMENT

BACKGROUND OF THE INVENTION

1. Field of the Invention

This invention relates generally to spectator seating systems, and more particularly, to a grandstand seating arrangement that can be displaced vertically.

2. Description of the Related Art

Different sporting events require different spectator seating heights to optimize the viewing angles, i.e., sight lines, experienced by the spectators. This is particularly the case in arenas that alternate, for example, between hockey and basketball events. It is desired that the spectator seating be made higher during hockey events than during basketball events. During a hockey event, not only does a more elevated spectator obtain a better sight line of the puck on the ice, the elevated spectator is less likely to be in the path of puck travel. In a typical arena that would hold hockey and basketball events, the seating arrangement, which is more in the nature of grandstand seating, is not movable.

There are, however, other spectator seating situations where there is a need for variability in the spectator seating height. Conventional grandstand seating arrangements generally have a fixed height between respective seating levels. When bleacher or grandstand seating arrangements are situated next to each other, it is desired that the respective seating levels be substantially co-planar with each other. In such situations, the respective bleacher or grandstand seating arrangements will have equal heights between the respective seating levels, and it therefore is desired to control of the elevation of a plurality of seating levels simultaneously.

In addition to the foregoing, it is desired in some spectator seating arrangements that a bleacher or grandstand seating system be vertically deployable to achieve a usable seating height, and that it be deployed downward in its entirety so that its reduced height permits it to be stored in areas having relatively low height dimensions, as would be the case with gymnasiums having mezzanines or elevated running tracks beneath which the bleacher or grandstand seating arrangements are desired to be stored.

There is therefore a need for a seating arrangement that can be deployed to a desired elevation, and which can be adapted and optimized for particular spectator activities.

It is, therefore, an object of this invention to provide a simple seating arrangement that can be in deployed to a predetermined height within a continuous range of heights.

It is another object of the invention to provide a seating arrangement that can support its full load rating irrespective of the height at which it is deployed.

It is also an object of the invention to provide a seating arrangement that can be deployed vertically to a plurality of selectable seating level heights that are optimized for different spectator activities.

It is a further object of his invention to provide a seating arrangement where the various ends and corners thereof can individually be raised and/or lowered so that the seating arrangement can be leveled over an uneven support surface.

SUMMARY OF THE INVENTION

The foregoing and other objects are achieved by this invention which provides, in a specific illustrative embodiment thereof, a grandstand seating arrangement that has a plurality of seating level members each having first and second ends and arranged in sequentially elevated relation to one another by a first predetermined height, wherein each such seating level member is disposed below an immediately superior seating level member. A rigid frame is coupled to, and arranged to surround, the plurality of seating elements. There is additionally provided a plurality of lifting arrangements, the individual lifting elements being coupled to various parts of the rigid frame for displacing same vertically. The rigid frame is coupled to the plurality of lifting arrangements by a corresponding plurality of couplers.

In one embodiment of the invention, each of the lifting arrangements is provided with a rotatory drive for producing a torque. Additionally, a screw drive arrangement is coupled to the rotatory drive and is rotated thereby. The screw drive arrangement is engaged with a respective one of the couplers of the rigid frame.

In a further embodiment of the invention, there is provided a plurality of stanchion supports, each of which is associated with a respective one of the plurality of seating level members. A lower stop is disposed on each of the stanchion supports and is arranged at a determined height that is responsive to the height of the associated seating level member relative to the height of the other seating level members. In a practicable embodiment of the invention, the stanchion supports are arranged in pairs, each member of the pair being disposed at a respective end of the associated one of the seating level members. Those of the stanchion supports that are associated with the same one of the seating level members have their respective lower stops disposed at substantially the same respective height.

In a still further embodiment of the invention, there is provided a plurality of seating level member supports, each such seating level member support being coupled to, and displaceable along, the stanchion support that is associated with the respectively associated one of the plurality of seating level members. Each of the seating level member supports is provided with a frame coupler for communicating with the rigid frame, the seating level member support being displaced along the stanchion support that is associated with the respectively associated one of the plurality of seating level members in response to displacement of the rigid frame by the plurality of lifting elements. The rigid frame couples sequentially to the seating level member supports, the sequence being responsive to the heights of their associated frame couplers.

In a practicable embodiment of the invention, the rigid frame is formed of a lower frame portion that is coupled to the plurality of lifting arrangements. Additionally, there is provided an upper frame portion, coupled rigidly to the lower frame portion, for communicating with the frame couplers of the seating level member supports.

Forward-most ones of the seating level members are installed upon a further rigid frame that is coupled to the aforementioned rigid frame. This forward rigid frame is provided with a locking support that bears at least a portion of the weight of the further rigid frame.

In accordance with a method aspect of the invention, there is provided a method of deploying a grandstand seating arrangement of the type having a plurality of seating level members. In accordance with the invention, the method is provided with the steps of:

upward driving a rigid frame vertically in an upward direction;

engaging sequentially a plurality of seating level member supports, each such seating level member support being associated with a respective one of the seating level members; and urging, in response to said step of upward driving, the plurality of seating level members sequentially upwardly.

In one embodiment of this method aspect of invention, the step of engaging includes the further step of sequentially supporting a frame coupler of each seating level member support with the rigid frame during the step of upward driving. The step of upward driving includes the step of operating a lift arrangement coupled to the rigid frame. In an embodiment where the lift arrangement is a screw jack, the step of upward driving includes the further step of rotating the screw jack which is coupled to the rigid frame. After performing the step of upward driving, there is provided the step of downward driving wherein the plurality of seating level member supports are sequentially released to be supported on a lower stop of an associated stanchion support. During performance of the steps of upward driving and downward driving there is provided the step of displacing the plurality of seating level member supports axially along their respectively associated stanchion supports.

In accordance with a further apparatus aspect of the invention, there is provided a grandstand seating arrangement having a plurality of seating level members, each having first and second ends and arranged in sequentially elevated relation to one another by a first predetermined height. Each such seating level member is disposed below an immediately superior seating level member. A rigid frame is coupled to, and arranged to surround, the plurality of seating elements. The rigid frame has a lower frame portion coupled to the plurality of lifting arrangements, and an upper frame portion coupled rigidly to the lower frame portion. A plurality of lifting arrangements is coupled to the lower frame portion of the rigid frame for displacing same vertically. Additionally, there is provided a plurality of stanchion supports, each such stanchion support being associated with a respective one of the plurality of seating level members. A lower stop is disposed on each stanchion support and arranged at a respective height that is responsive to the height of the associated seating level member relative to the other seating level members. A plurality of seating level member supports each support a respectively associated one of the plurality of seating level members. Each such seating level member support is coupled to, and displaceable along, the stanchion support that is associated with the respectively associated one of the plurality of seating level members.

The plurality of seating level member supports are arranged to be supported by associated lower stops when the lifting arrangements are in the lowermost position. When the lifting arrangements are operated to raise the rigid frame, the seating level member supports, and the seating levels thereon, are sequentially raised from the respective associated lower stops.

In one embodiment of this further aspect of the invention, there is provided a further rigid frame that is coupled to the rigid frame and arranged forward thereof for supporting at least a lower one of the seating level members. Additionally, there is provided a locking support arrangement that supports the further rigid frame. The locking support arrangement, in one embodiment, is manually locked when the seating level members have reached the desired height.

BRIEF DESCRIPTION OF THE DRAWING

Comprehension of the invention is facilitated by reading the following detailed description, in conjunction with the annexed drawing, in which.

DETAILED DESCRIPTION

Figure 1:
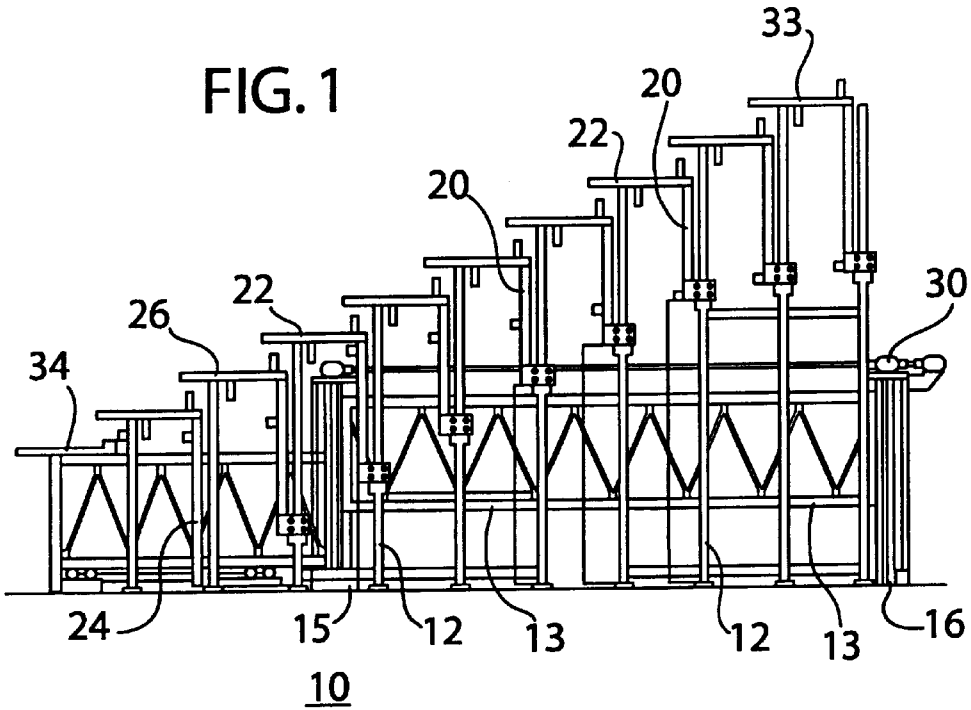
FIG. 1 is a schematic side representation of a specific illustrative embodiment of the invention showing a grandstand seating arrangement in a lowered position.

FIG. 1 is a schematic side representation of a specific illustrative embodiment of the invention showing a grandstand seating arrangement 10 in a lowered position. As shown in this figure, the grandstand seating arrangement has a plurality of stanchions 12 that are arranged vertically and the parallel to one another, one end thereof being disposed on the ground, of the stanchions having different heights arranged in a sequential progression. A rigid frame 13 is shown to extend horizontally between first and second screw jacks 15 and 16, respectively. Each of stanchions 12 is provided with an associated seating level member support 20 on which is installed a respective one of seating level members 22. In addition, there is shown a forward rigid frame 24 on which are disposed a plurality of seating level members 26.

Figure 2:
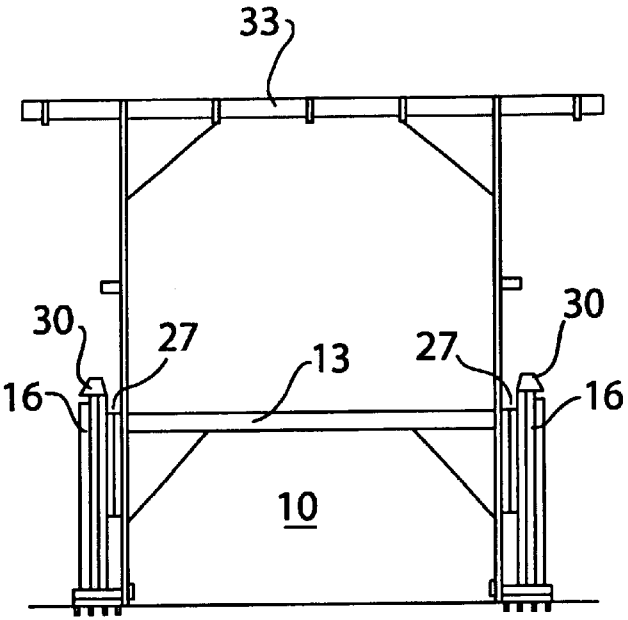
FIG. 2 is a rear view of the embodiment of FIG. 1.

FIG. 2 is a rear view of grandstand seating arrangement 10, shown in FIG. 1. This figure has been simplified for clarity. As shown in FIG. 2, screw jacks 16 are provided at each corner of rigid frame 13. In addition, rigid frame 13 is shown to be in a lowered position whereby its associated upper frame portion 27 is disposed below rotatory drives 30 that operate the screw jacks, as described hereinbelow.

Figure 3:
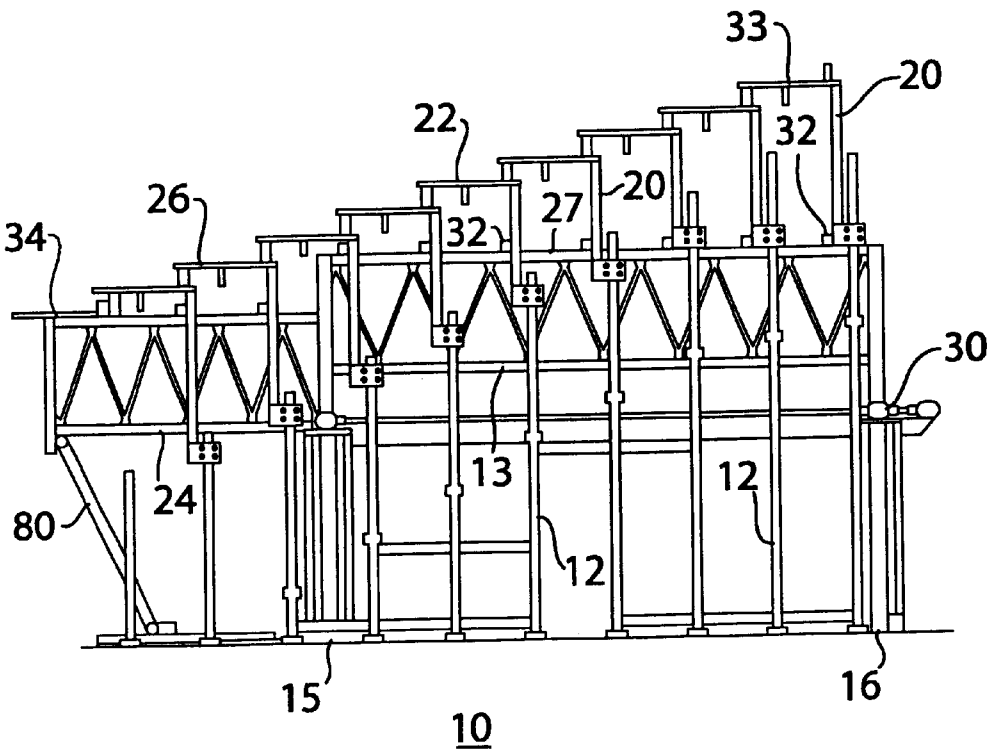
FIG. 3 is a schematic side representation of the embodiment of FIG. 1 showing the grandstand seating arrangement in a raised position.

FIG. 3 is a schematic side representation of grandstand seating arrangement 10 of FIG. 1 shown in a raised position. Elements of structure that previously have been discussed are similarly designated. This figure shows upper frame portion 27 to be in communication with a plurality of frame couplers 32 associated with respective ones of seating level member supports 20. Each of the seating level member supports, therefore, has been raised along its associated stanchion, as described hereinbelow.

Figure 4:
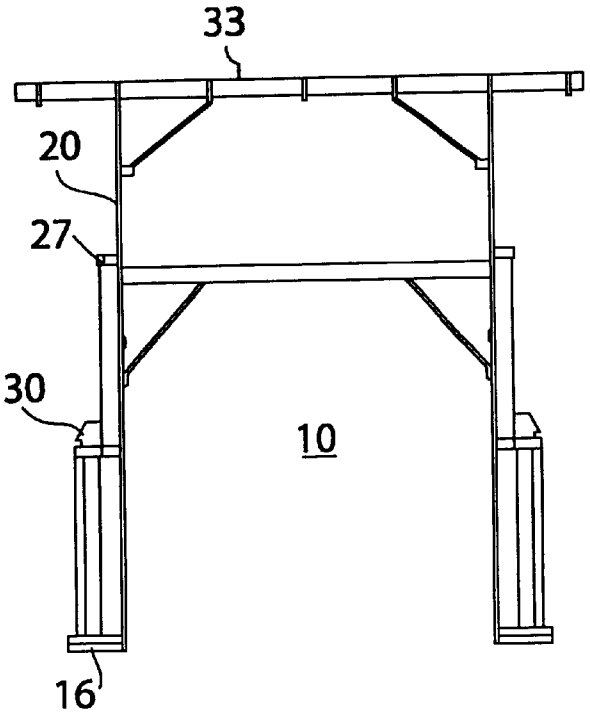
FIG. 4 is a rear view of the embodiment of FIG. 3.

FIG. 4 is a rear view of the embodiment of grandstand seating arrangement 10, shown in FIG. 3. This figure has been simplified for clarity. As shown in the various figures, screw jacks 16 are provided at each corner of rigid frame 13. In addition, rigid frame 13 is shown in FIG. 4 to be in a raised position whereby its associated upper frame portion 27 is disposed above rotatory drives 30 that operate the screw jacks, as will be described hereinbelow. FIGS. 1–4 show that the height of an uppermost seating level 33 is not affected by the raising or lowering of rigid frame 13. On the other hand, with reference to FIGS. 1 and 3 it is seen that the height of a lowermost seating level 34, in this specific illustrative embodiment of the invention, is most greatly affected by the raising or lowering of rigid frame 13.

Figure 5:
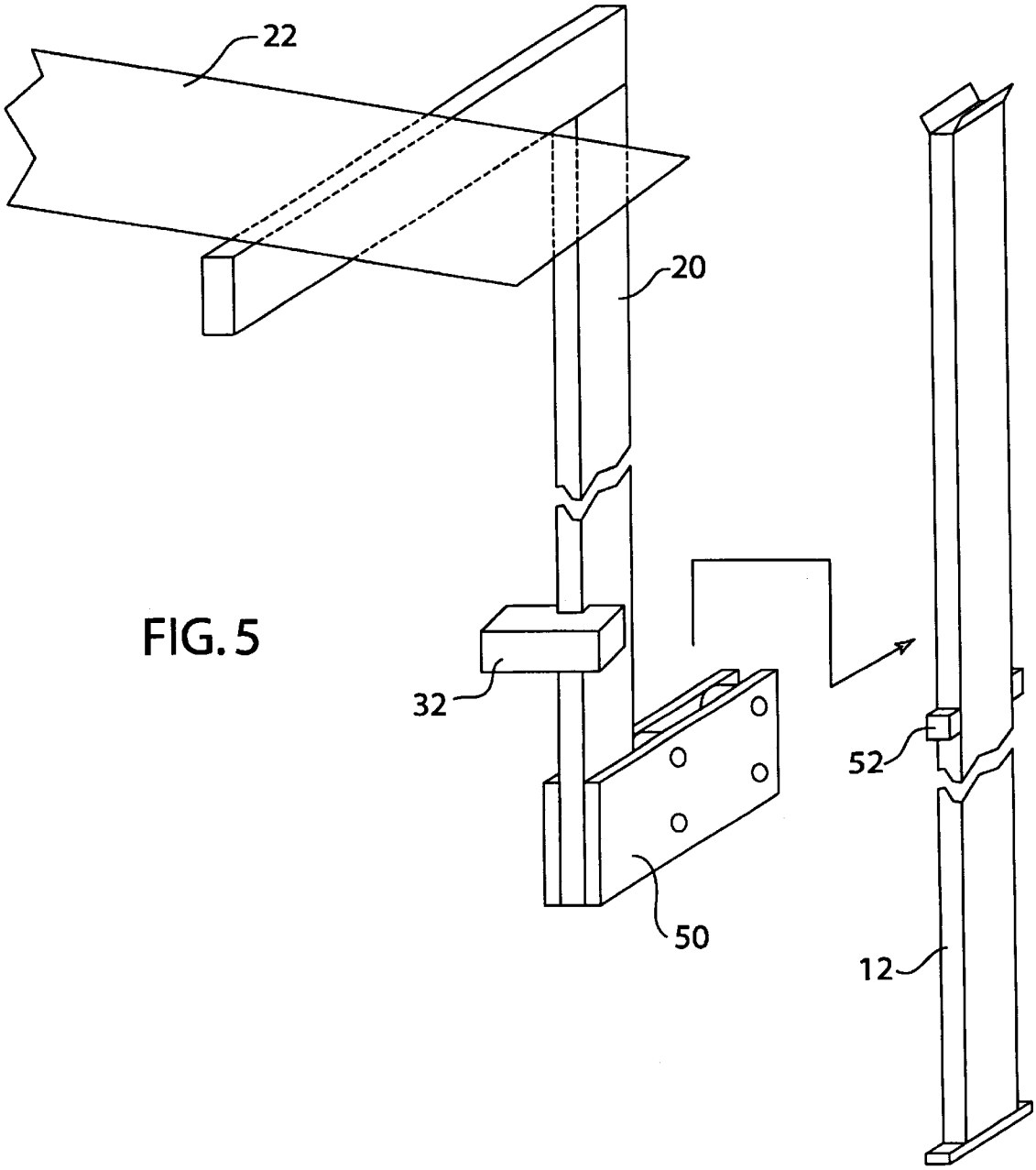
FIG. 5 is an exploded, partially fragmented, schematic representation of a grandstand seating level member, a seating level member support, and a stanchion.

FIG. 5 is an exploded, partially fragmented, schematic representation of a grandstand seating level member 22 being supported on an associated seating level member support 20. As shown, seating level member support 20 is provided with a roller arrangement 50 that is arranged to engage with a stanchion 12 so as to be axially displaceable therealong. Stanchion 12 is shown to have a lower stop 52 that supports seating level member support 20 at a lowermost position. The seating level member support is provided with frame coupler 32 that engages with upper frame portion 27 of rigid frame 13.

Figure 6:
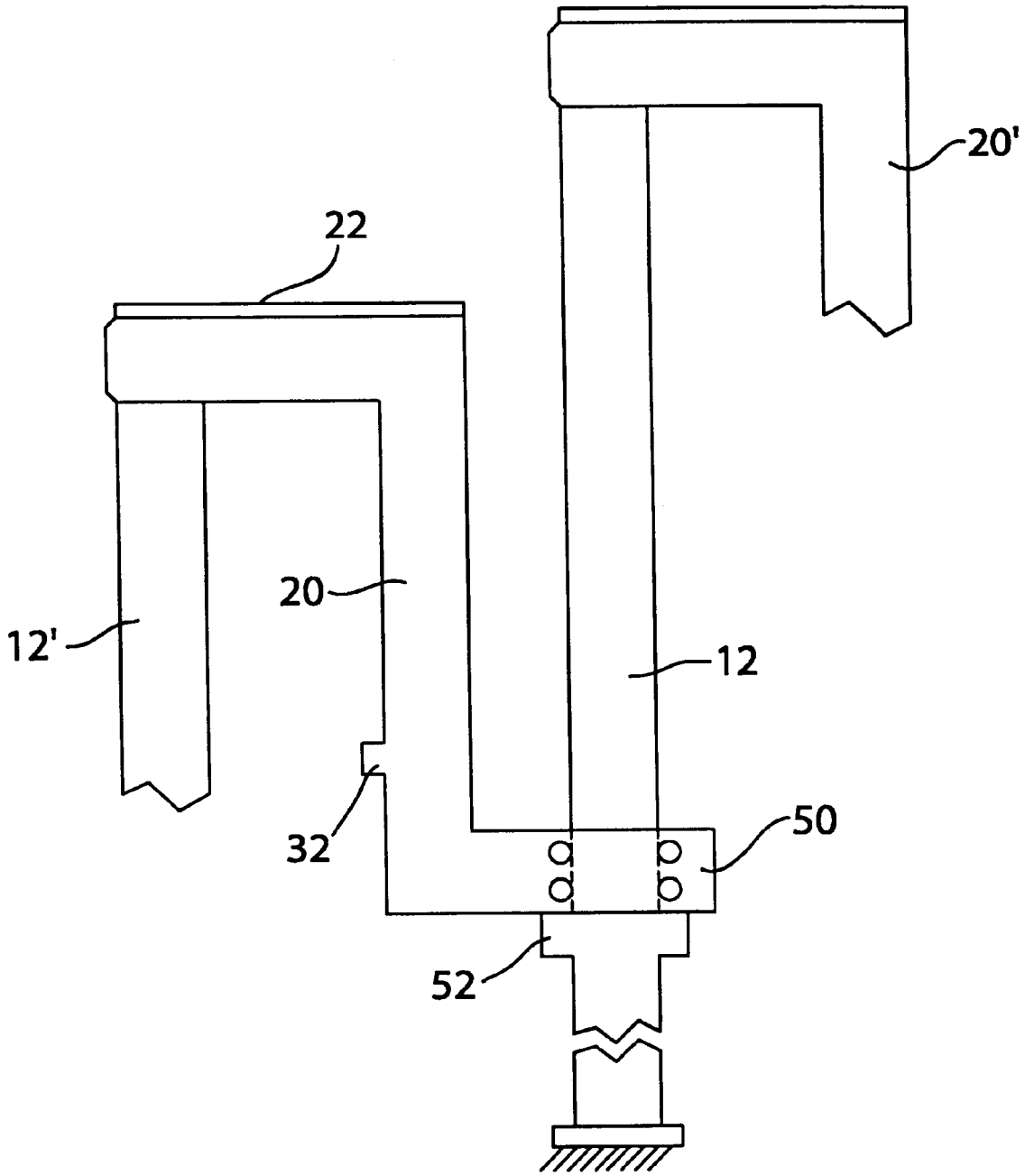
FIG. 6 is a simplified schematic representation of adjacent seating level members.

FIG. 6 is a simplified schematic representation that shows seating level support member 20 with seating level member 22 thereon engaged with stanchion 12, as previously described, in the lowered position. All elements of structure in a superior seating level member support 20' that bear analogous correspondence to those associated with superior seating level member support 20 are similarly designated, but with a prime ("'"). The figure additionally shows and immediately superior seating level support member 20' that, when in the lowered position, rests upon the top of stanchion 12. Similarly, seating level member support 20 rests on and immediately inferior stanchion 12'.

Figure 7:
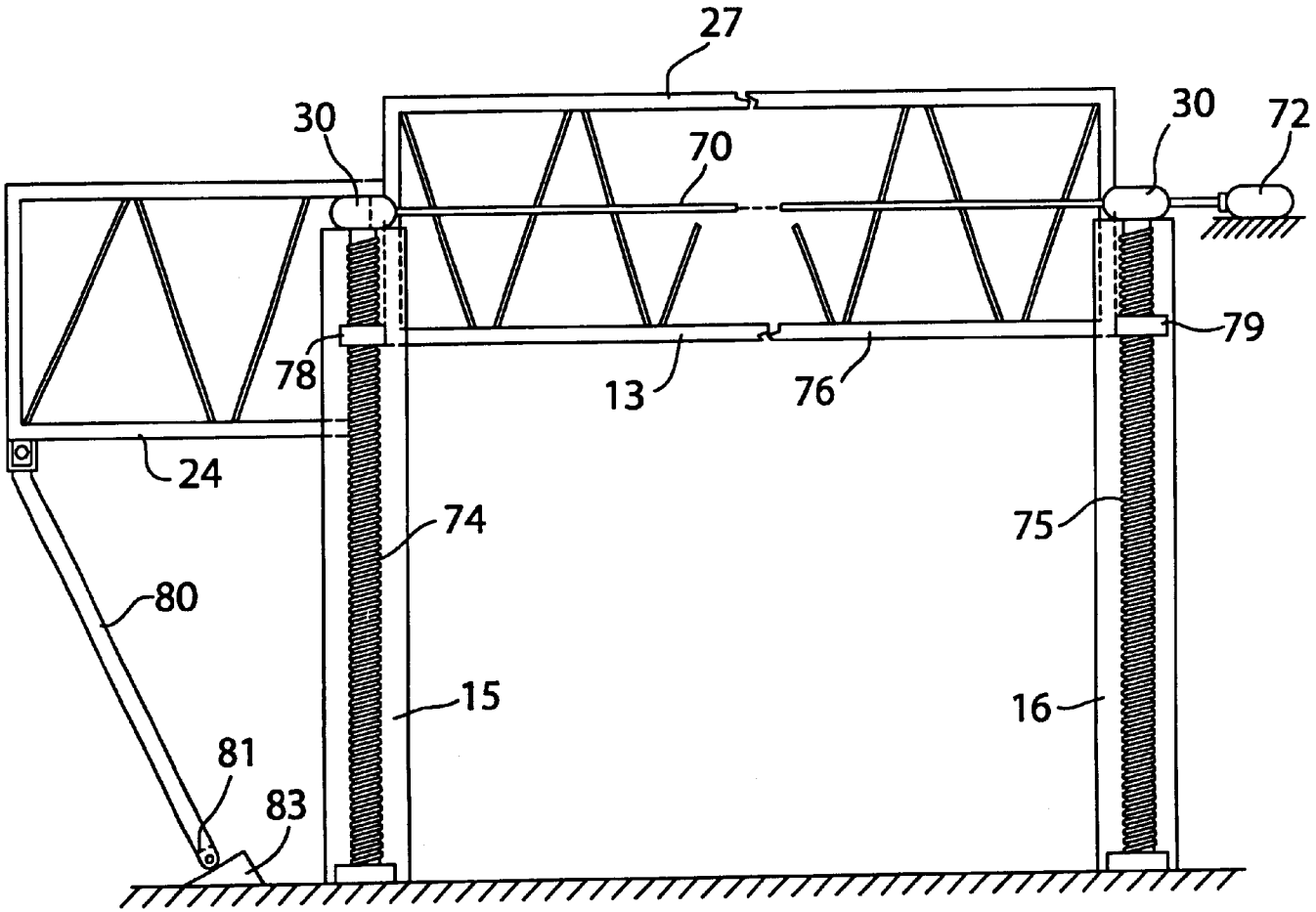
FIG. 7 is a schematic representation of a rigid frame and a pair of screw jacks with interconnected drives.

FIG. 7 is a simplified schematic representation of screw jacks 15 and 16 showing rigid frame 13 in a raised position. This figure additionally shows rotatory drives 30 coupled to one another via a drive shaft 70. Rotational energy is supplied by a drive motor 72 which, in this embodiment, constitutes an electrical embodiment. Each of the screw jacks is shown to have an associated one of screw gears 74 and 75 coupled to an associated one of rotatory drives 30. Rigid frame 13 has a lower frame portion 76 that is coupled to couplers 78 and 79 engaged with respective ones of screw gears 74 and 75. Thus, as screw gears 74 and 75 are each rotated in response to drive motor 72, rigid frame 13 is displaced vertically. Forward rigid frame 24 is coupled to rigid frame 13 and therefore also is displaced vertically in response to actuation of drive motor 72.

FIG. 7 additionally shows a support arm 80 that is pivotally coupled to forward rigid frame 24. The support arm is provided with a roller 81 at its distal end. In this embodiment of the invention, the distal end of support arm 80 and manually be locked into the shown position by operation of a manual lock 83 that is schematically shown. This provides, in certain embodiments, additional necessary support to forward rigid frame 24.

Figure 8:
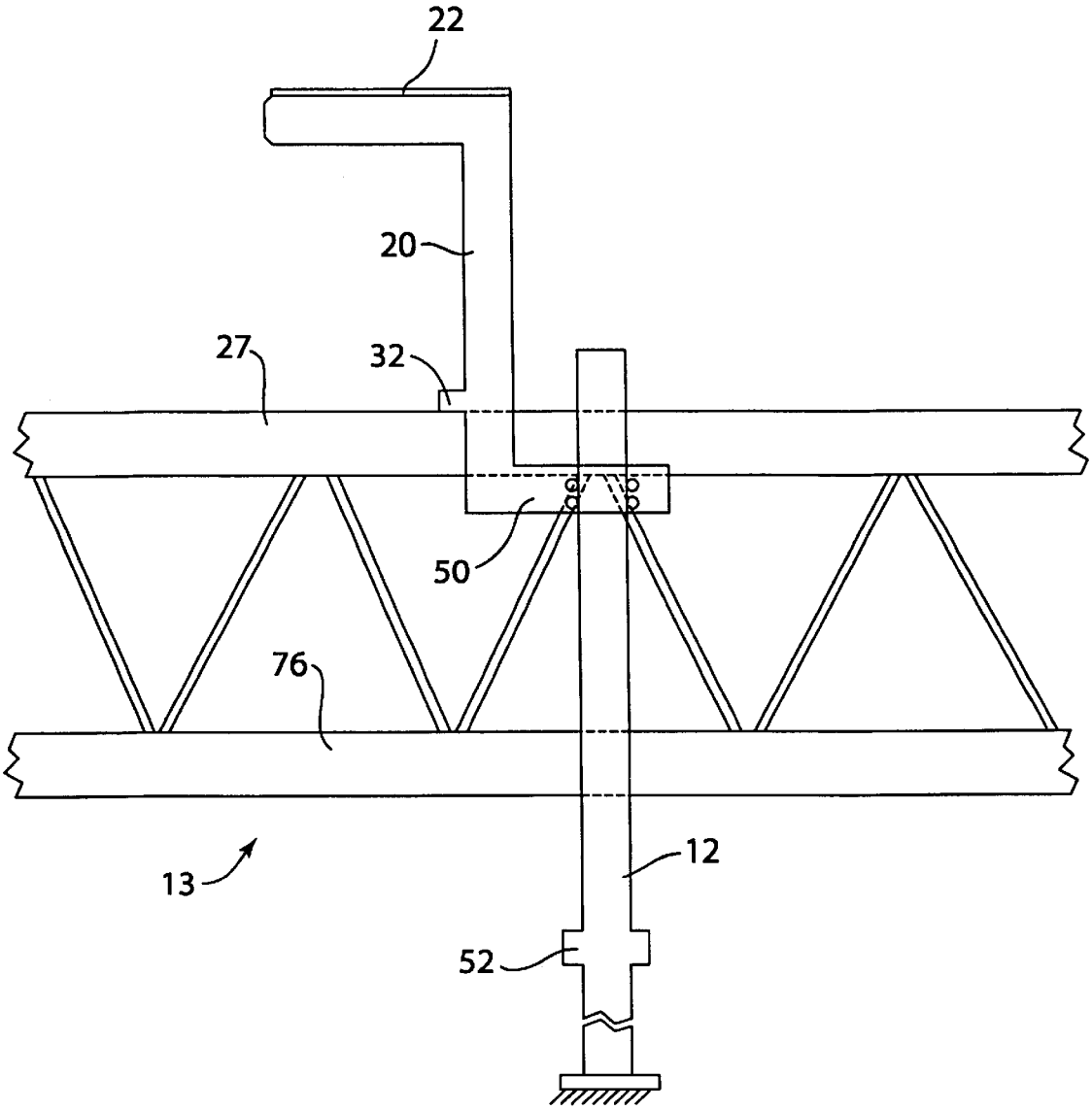
FIG. 8 is a schematic representation of a seating level member support engaged with the rigid frame.

FIG. 8 is a schematic representation of seating level member support 20 with seating level member 22 thereon in a raised position. Elements of structure that previously have been discussed are similarly designated. A shown, frame coupler 32 is engaged with upper frame portion 27 of rigid frame 13. Thus, roller arrangement 50 has been raised above lower stop 52 of stanchion 12.

Figure 9:
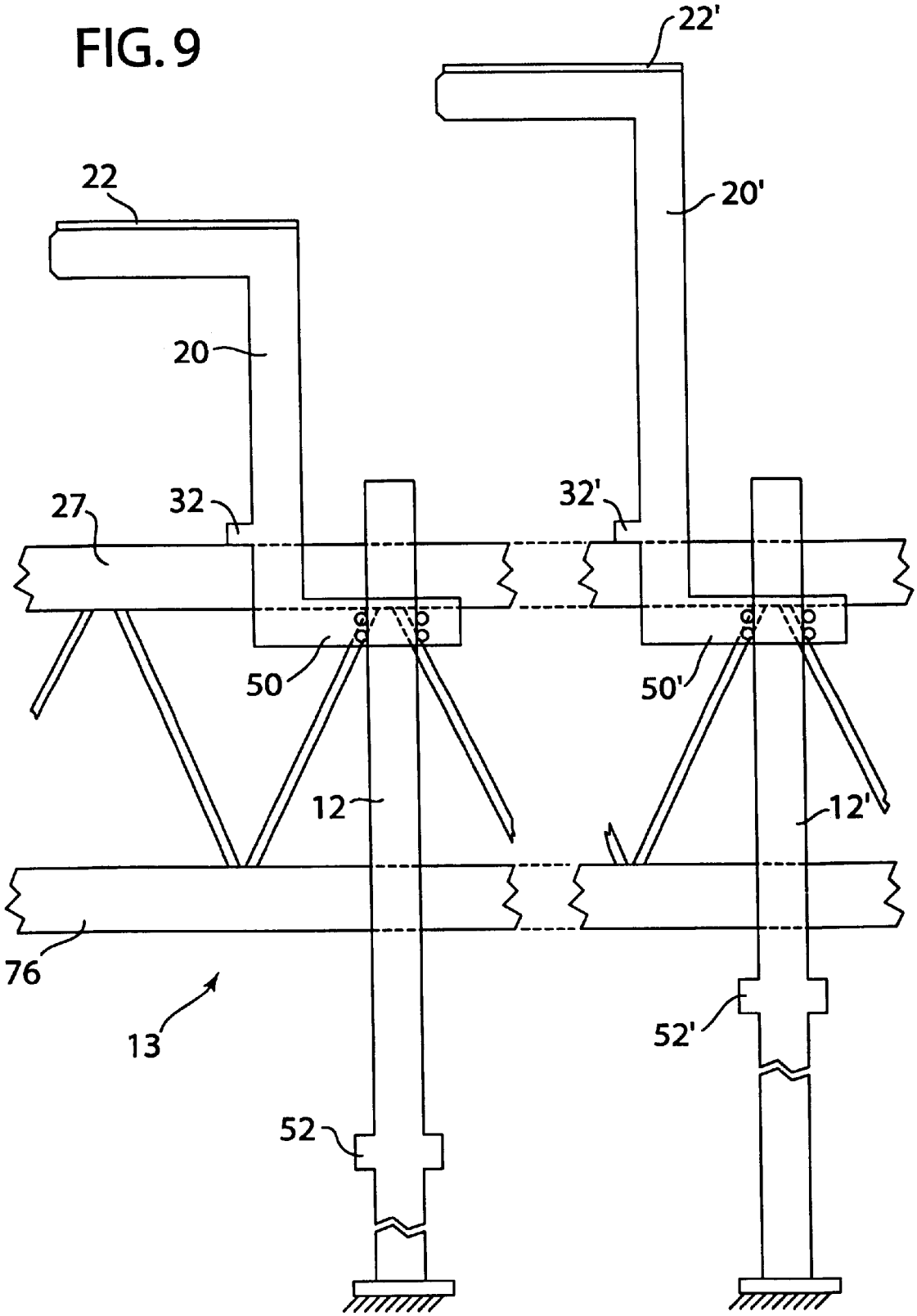
FIG. 9 is a schematic presentation of a pair of seating level member supports engaged with the rigid frame.

FIG. 9 is a schematic representation of seating level member support 20 as discussed hereinabove with respect to FIG. 8, and further showing an immediately superior seating level member support 20'. As shown, lower stop 52 is disposed lower than lower stop 52'. Therefore, as rigid frame 13 was urged upward, as previously described, upper frame portion 27 engaged frame coupler 32 before it engaged frame coupler 32'. Thus, the seating level member supports are raised sequentially, depending upon their relative heights.

Figure 10:
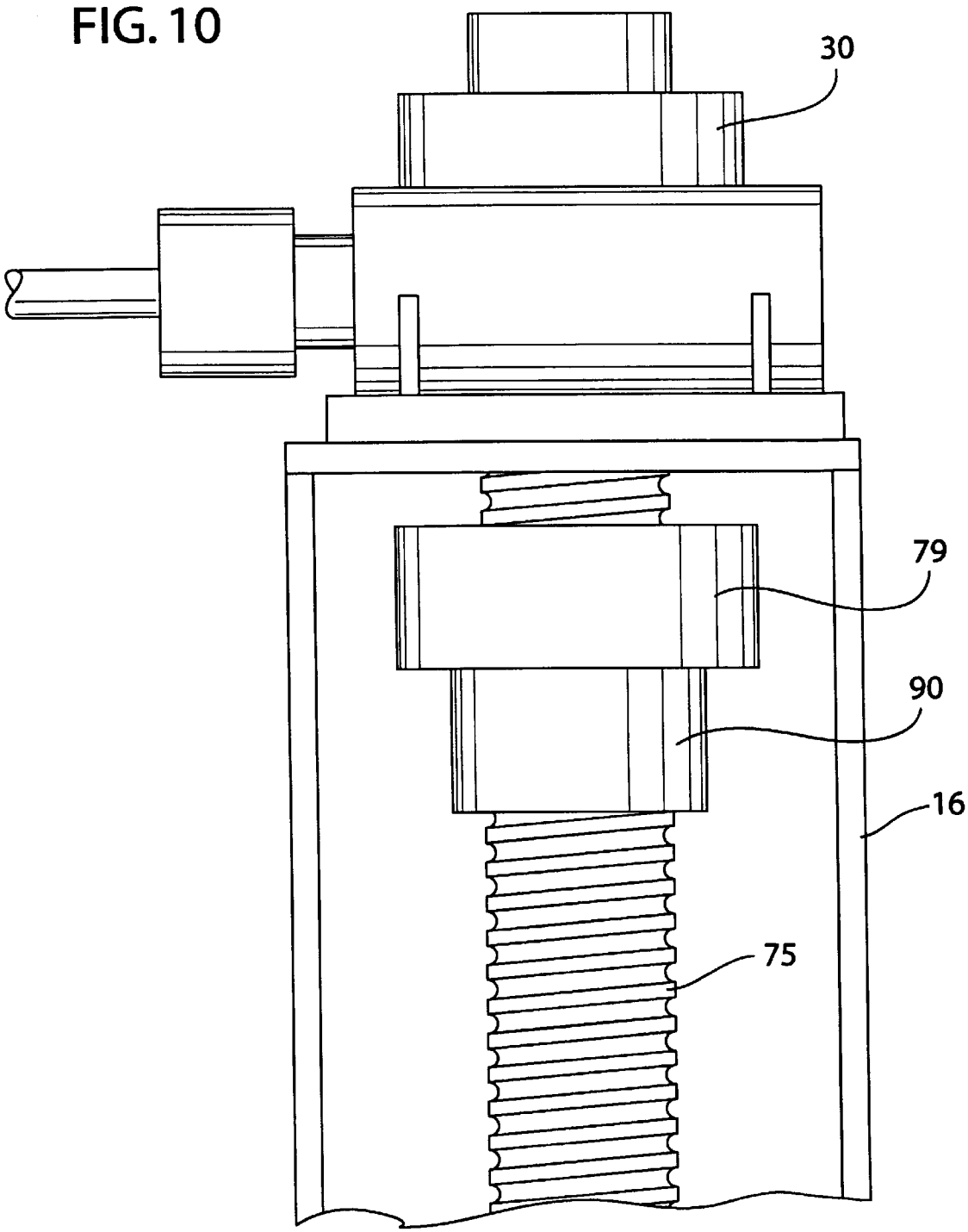
FIG. 10 is an isometric representation of a screw jack engaged with a coupler, and showing a rotatory drive.

FIG. 10 is an isometric representation of screw jack 16 engaged with coupler 79, and showing rotatory drive 30. The rotatory drive is coupled to screw gear 75 and causes same to rotate in response to rotation of drive shaft 70. In this specific illustrative embodiment of the invention, coupler 79 is shown to be disposed on an engagement member 90.

Figure 11:
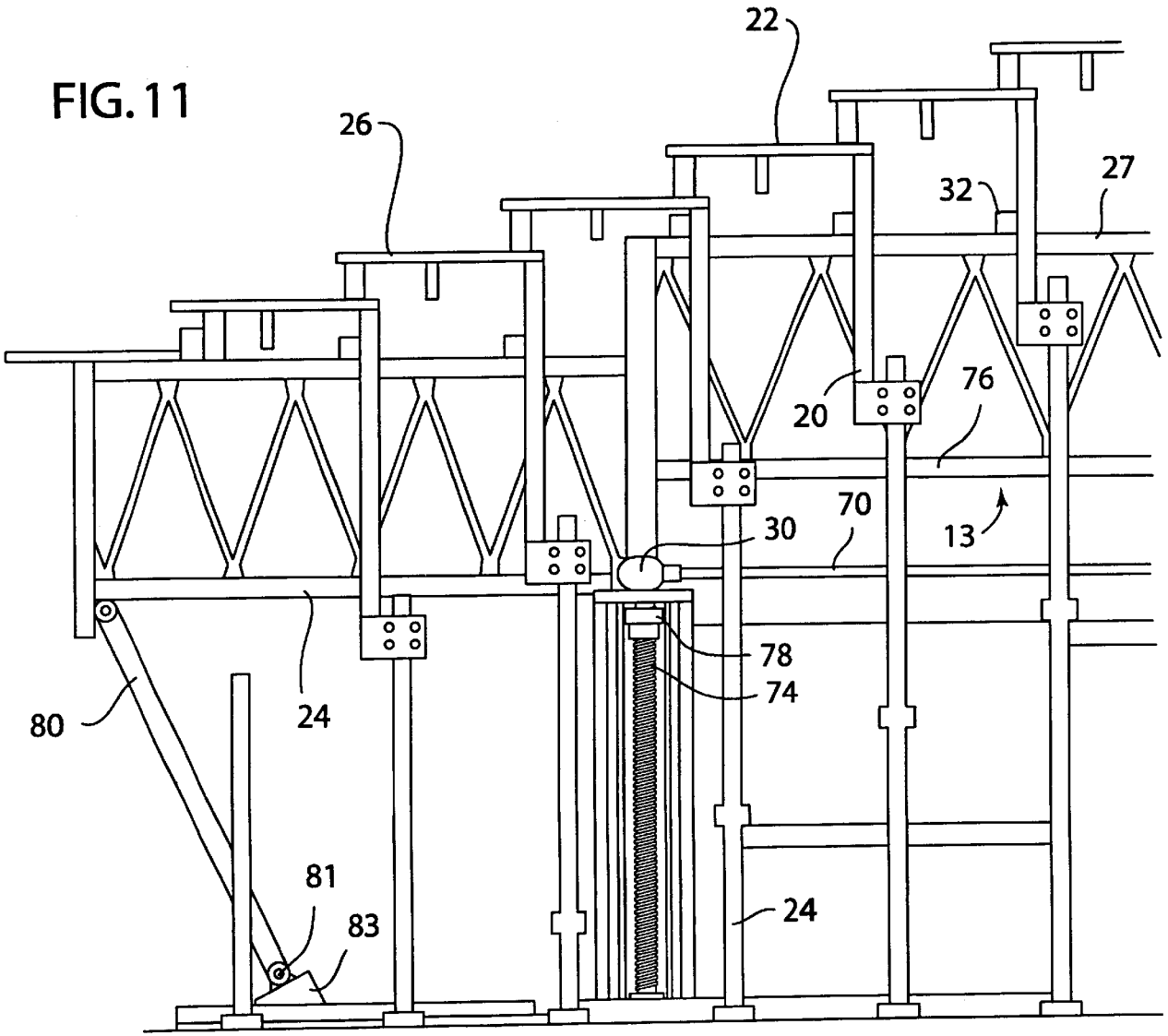
FIG. 11 is a perspective representation of an embodiment of the invention showing a forward rigid frame supporting forward ones of the seating level members.

FIG. 11 is a perspective representation of an embodiment of the invention showing forward rigid frame 24 into the upward position supporting forward ones of seating level members 26. In addition, this figure shows a forward rigid frame 24 supported by support arm 80 which is in the locked position, as previously described. Upper frame portion 27 of rigid frame 13 is in its upwardmost position.

Figure 12:
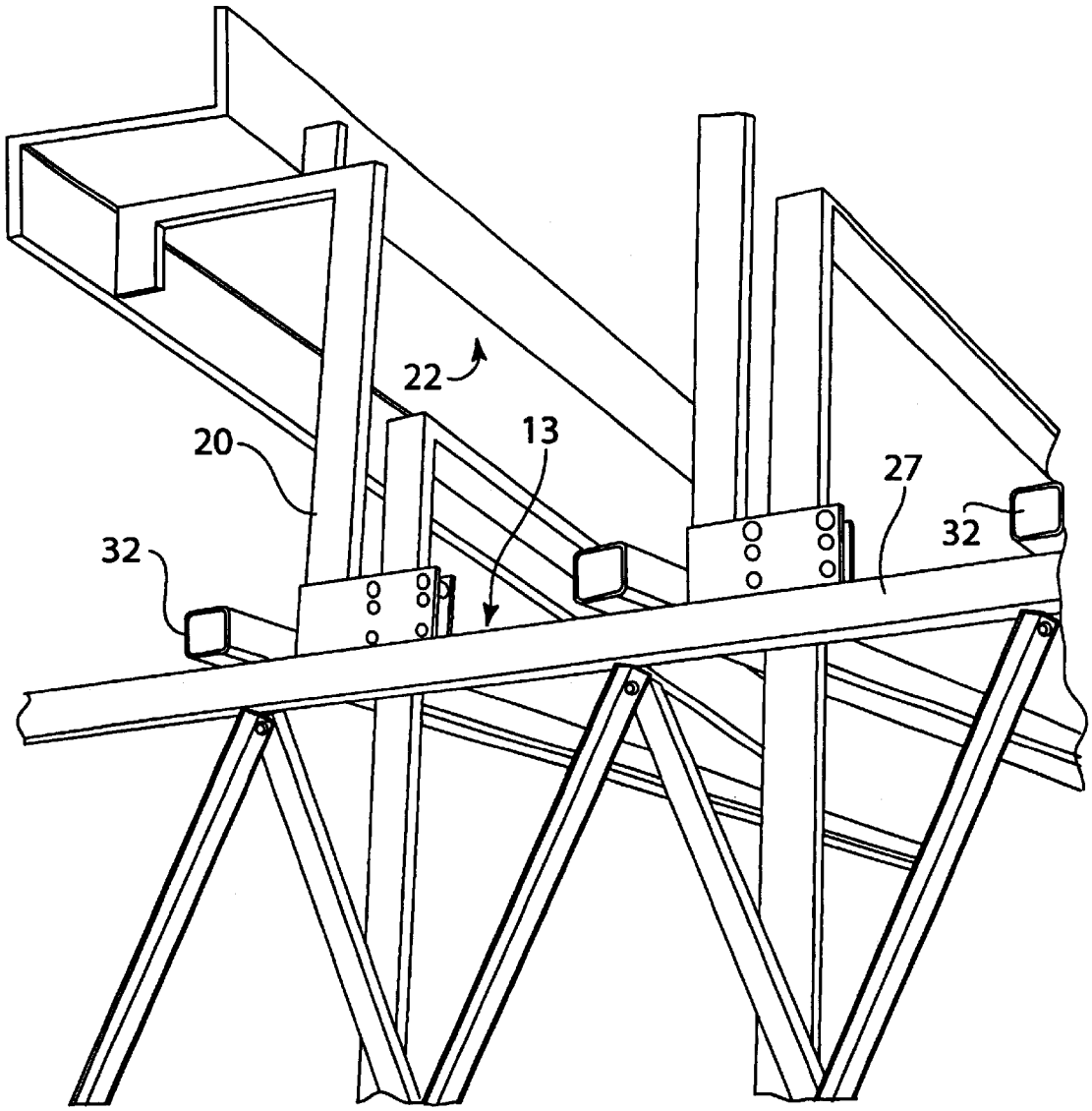
FIG. 12 is a perspective representation of an embodiment of the invention showing the grandstand seating arrangement in a raised position and the engagement between the rigid frame and the frame couplers of respective ones of the seating level member supports.

FIG. 12 is a perspective representation of an embodiment of the invention showing the grandstand seating arrangement in a raised position and the engagement between rigid frame 13 and frame couplers 32 of respective ones of seating level member supports 20. The frame couplers are shown to be disposed on upper frame portion 27 of rigid frame 13. In this figure, the rigid frame is in its upward-most position.

Figure 13:
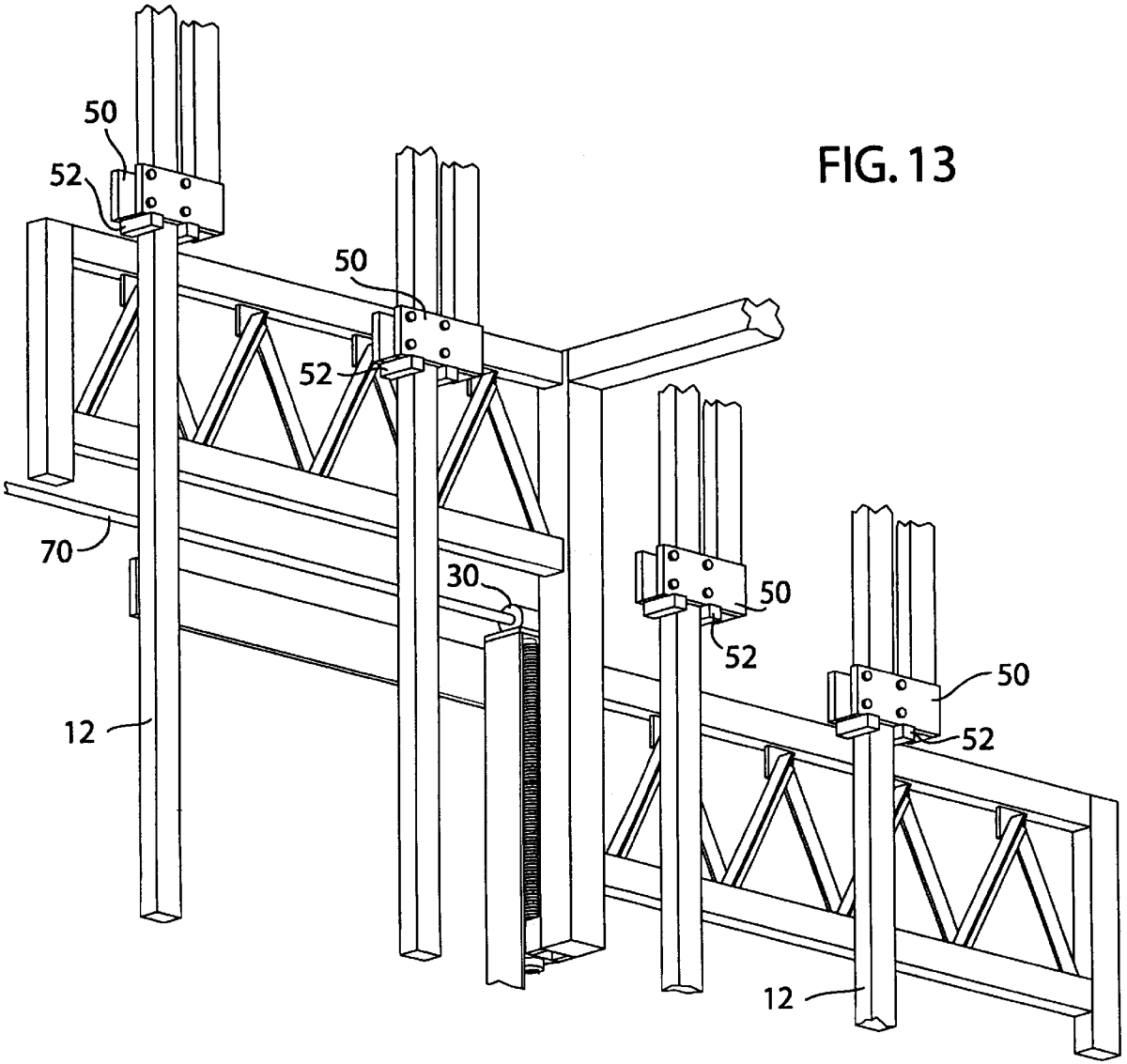
FIG. 13 is a perspective representation of an embodiment of the invention showing the grandstand seating arrangement in a lowered position and the engagement between the seating level member supports and the lower stops the stanchions.

FIG. 13 is a perspective representation of an embodiment of the invention showing grandstand seating arrangement 10 in a lowered position and the engagement between seating level member supports 20 and lower stops 52 of stanchions 12.

Although the invention has been described in terms of specific embodiments and applications, persons skilled in the art can, in light of this teaching, generate additional embodiments without exceeding the scope or departing from the spirit of the invention described herein. Accordingly, it is to be understood that the drawing and description in this disclosure are proffered to facilitate comprehension of the invention, and should not be construed to limit the scope thereof.

What is claimed is:

1. A grandstand seating arrangement comprising, in combination:

a plurality of seating level members each having first and second ends and arranged in sequentially elevated relation to one another by a first predetermined height, wherein each such seating level member is disposed below an immediately superior seating level member;

a rigid frame coupled to, and arranged along, the first and second ends of said plurality of seating level members;

a plurality of lifting arrangements coupled to said rigid frame for displacing said rigid frame vertically;

a plurality of couplers for coupling said rigid frame to said plurality of said lifting arrangements, whereby actuation of said plurality of lifting arrangements causes vertical displacement of said rigid frame and said plurality of seating level members coupled thereto;

a plurality of stanchion supports, each stanchion support being associated with a respective one of said plurality of seating level members; and a lower stop disposed on each stanchion support arranged at a respective height that is responsive to the height of the respective one of said plurality of seating level members relative to other seating level members;

wherein there is further provided a plurality of seating level member supports each for supporting a respectively associated one of said plurality of seating level members, each seating level member support being coupled to, and displaceable along, said stanchion support that is associated with the respectively associated one of said plurality of seating level members.

2. The grandstand seating arrangement of claim 1, wherein each of said lifting arrangements comprises:

a rotatory drive for producing a torque; and a screw drive arrangement coupled to said rotatory drive so as to be rotated thereby, and being engaged with a respective one of said couplers.

3. The grandstand seating arrangement of claim 1, wherein said plurality of stanchion supports are arranged in pairs, each such pair being disposed at respective ends of a respectively associated one of said seating level members, said stanchion supports associated with the respectively associated one of said seating level members having the respective lower stops disposed at substantially the same respective height.

4. The grandstand seating arrangement of claim 1, wherein each of said seating level member supports is provided with a frame coupler for communicating with said rigid frame, said seating level member support being displaced along said stanchion support that is associated with the respectively associated one of said plurality of seating level members in response to displacement of said rigid frame by said plurality of lifting arrangements.

5. The grandstand seating arrangement of claim 4, wherein said rigid frame couples sequentially to said seating level member supports, in response to the heights of the associated frame coupler.

6. The grandstand seating arrangement of claim 4, wherein said rigid frame comprises:

a lower frame portion coupled to said plurality of lifting arrangements; and an upper frame portion coupled rigidly to said lower frame portion for communicating with the frame couplers of said seating level member supports.

7. A grandstand seating arrangement comprising, in combination:

a plurality of seating level members each having first and second ends and arranged in sequentially elevated relation to one another by a first predetermined height, wherein each such seating level member is disposed below an immediately superior seating level member;

a rigid frame coupled to, and arranged along, the first and second ends of said plurality of seating level members;

a plurality of lifting arrangements coupled to said rigid frame for displacing said rigid frame vertically; and a plurality of couplers for coupling said rigid frame to said plurality of said lifting arrangements, whereby actuation of said plurality of lifting arrangements causes vertical displacement of said rigid frame and said plurality of seating level members coupled thereto;

wherein there is further provided a further rigid frame coupled to said rigid frame and arranged forward of said rigid frame for supporting at least a lower one of said seating level members.

8. A method of deploying a grandstand seating arrangement of the type having a plurality of seating level members, the method comprising, in combination, the steps of:

upward driving a rigid frame vertically in an upward direction;

engaging sequentially a plurality of seating level member supports, each such seating level member support being associated with a respective one of the seating level members;

urging upwardly and sequentially, in response to said step of upward driving the rigid frame, the plurality of seating level member supports and the seating level members; and downward driving the rigid frame vertically in a downward direction;

wherein during performance of said step of downward driving there is provided the step of sequentially releasing the plurality of seating level member supports to be supported on a lower stop of an associated stanchion support.

9. The method of claim 8, wherein said step of engaging comprises the further step of sequentially supporting a frame coupler of each seating level member support with the rigid frame, during said step of upward driving.

10. The method of claim 8, wherein said step of upward driving comprises the further step of operating a lift arrangement coupled to the rigid frame.

11. The method of claim 10, wherein said step of operating a lift arrangement comprises the further step of rotating a screw jack coupled to the rigid frame.

12. The method of claim 8 wherein during performance of said steps of upward driving and downward driving there is provided the step of displacing the plurality of seating level member supports axially along the respectively associated stanchion supports.

13. A grandstand seating arrangement comprising:

a plurality of seating level members each having first and second ends and arranged in sequentially elevated relation to one another by a first predetermined height, wherein each such seating level member is disposed below an immediately superior seating level member;

a rigid frame coupled to, and arranged along, the first and second ends of said plurality of seating level members, said rigid frame having;

a lower frame portion coupled to said plurality of lifting arrangements; and an upper frame portion coupled rigidly to said lower frame portion;

a plurality of lifting arrangements coupled to said lower frame portion of said rigid frame for displacing said rigid frame and said plurality of seating level member coupled thereto vertically;

a plurality of stanchion supports, each stanchion support being associated with a respective one of said plurality of seating level members;

a lower stop disposed on each stanchion support and associated with a seating level member, said lower stop being arranged at a height that is responsive to the height of the associated seating level member relative to others of said seating level members; and a plurality of seating level member supports each for supporting a respectively associated one of said plurality of seating level members, each seating level member support being coupled to, and displaceable along, said stanchion support that is associated with the respectively associated one of said plurality of seating level members.

14. The grandstand seating arrangement of claim 13, wherein said plurality of seating level member supports are each arranged to be supported by an associated lower stop when said lifting arrangements are in a lowermost position.

15. The grandstand seating arrangement of claim 14, wherein said plurality of seating level member supports are sequentially raised from said associated lower stop when said lifting arrangements is raised to an upward position.

16. The grandstand seating arrangement of claim 13, wherein there is further provided:

a further rigid frame coupled to said rigid frame and arranged forward of said rigid frame for supporting at least a lower one of said seating level members; and a locking support arrangement for supporting said further rigid frame.

* * * * *